US005976704A

United States Patent [19]

McCune

[11] Patent Number: 5,976,704

[45] Date of Patent: Nov. 2, 1999

[54] COMPOSITE METALLIZING WIRE AND METHOD OF USING

[75] Inventor: Robert Corbly McCune, Birmingham, Mich.

[73] Assignee: Ford Global Technologies, Inc., Dearborn, Mich.

[21] Appl. No.: 08/515,085

[22] Filed: Aug. 14, 1995

Related U.S. Application Data

[62] Division of application No. 08/203,914, Mar. 1, 1994, Pat. No. 5,514,422.

[51] Int. Cl.[6] ..... B32B 15/00

[52] U.S. Cl. ..... 428/469; 428/323; 428/325; 428/472; 428/698; 428/699

[58] Field of Search ..... 428/323, 325, 428/403, 469, 698, 472, 699; 427/446, 450, 451, 452

[56] References Cited

U.S. PATENT DOCUMENTS 5,194,304 3/1993 McCune ..... 427/449
5,358,753 10/1994 Rao ..... 427/451

*Primary Examiner*—Timothy Speer
*Attorney, Agent, or Firm*—Joseph W. Malleck

[57] ABSTRACT

A composite metallizing wire useful in thermal flame spraying, having a conductive metallic solid core wire strand and a coating consisting of solid lubricant particles (i.e., graphite, BN, Teflon) and wear-resistant particles (i.e., SiC, TiC, $Cr_3C_2$) homogeneously suspended in a conductive metal (i.e., Ni, Fe, Cr, Mo, Ti) complementary to said solid core wire strand.

A method of making such composite metallizing wire useful in thermal flame spraying, comprising submersing a solid core wire mandrel of conductive metal in a plating bath to act as a cathode, the bath containing conductive metal salt and an electrolyte having a salt with a depositable metal and a dispersant of wear-resistant particles (i.e., in an amount of from 20–150 grams/liter) and solid lubricant particles (i.e., in an amount of from 10–200 grams/liter), and energizing the electrolyte to codeposit metal from said electrolyte along with wear-resistant particles and solid lubricant particles onto said wire mandrel.

A method of thermal spraying to produce a metal matrix composite coating, comprising providing a thermalizing through-flow chamber with an exit nozzle, the chamber having a gas flow-through of at least 100 $ms^{-1}$, establishing a flame in said chamber, and feeding a composite coated wire into said flame to be melted and projected by the gas flow to a target, the wire being constructed as above.

1 Claim, 5 Drawing Sheets

COMPOSITE METALLIZING WIRE AND METHOD OF USING

This is a divisional of copending application Ser. No. 08/203,914 filed Mar. 1, 1994, now U.S. Pat. No. 5,514,422.

BACKGROUND OF THE INVENTION

1. Technical Field

This invention relates to the technology of thermally spraying hard surface coatings and, more particularly, to coatings which contain lubricant or wear-resisting particles.

2. Discussion of the Prior Art

Thermal spraying is a well-established branch of surface coating technology which produces deposits that add a variety of characteristics and properties to the coated component. It encompasses a number of different methods of spraying which differ in the materials employed and the methods used to melt them.

Essentially, these different methods fall into four basic categories: flame spraying, electric arc spraying, plasma spraying, and detonation spraying. Although these methods differ in the fuels and forms of heating they employ, and also in the nature of the feedstock material, they all retain the basic concept of creating hot particles which are subsequently atomized and projected toward a suitably prepared substrate. Upon striking the target, these hot particles deform with considerable force to produce a lamellar structure.

Wire, as a solid feedstock, has been used only with the flame spray and electric arc spray processes. The problem with the use of solid feedstock wire is that it is difficult to form a uniform homogeneous coating if it is a composite of various constituents. For example, graphite is particularly difficult to disperse and integrate into a molten body without dissolution. Adding powdered graphite either upstream or downstream of the electric arc or flame limits the desirable distribution of the graphite and may fail to prevent ablation (i.e., oxidation or dissolution) of the graphite as it is exposed to projecting gases or molten metal.

A cored feedstock wire has been created and disclosed in copending U.S. application Ser. No. 998,074 now U.S. Pat. No. 5,364,663, commonly assigned to the assignee of this invention; additive materials are contained and consolidated in a central hollow of the wire. This wire works well with electric arc spraying to induce homogeneity and inhibit ablation. However, when such cored feedstock wire is used in certain flame spray techniques such as high-velocity oxy-fuel (HVOF), variable chunks of the wire break off and are dispersed in a uniform, improperly melted manner.

Moreover, when such surface coating technology is transferred to the art of coating internal bores of a block, such as the cylinder bores of an internal combustion engine, with a composite coating we find the adhesive strength of the coating is not optimized sufficiently. It is desirable to use techniques that avoid chemical clean-up and costs associated with wet electrolytic deposition (see "Hard Surface coatings by Electric Arc Spraying", R. C. Cobb et al, Welding and Metal Fabrication, July 1988, pp. 226–231; and U.S. Pat. No. 3,929,596).

It thus remains a problem as to how to thermally spray composite coatings into the bores of an engine block constituted of a relatively low melting metal, i.e., aluminum alloy, with greater thermal energy to achieve a highly adherent coating and yet achieve exacting homogeneity in the coating.

SUMMARY OF THE INVENTION

The invention, in a first aspect, is a composite metallizing wire useful in thermal spraying having a conductive, metallic, solid-core wire strand and a codeposited metal matrix composite coating on the wire strand, the coating consisting of one or more constituents, examples being solid lubricant particles (i.e., graphite, BN, $MoS_2$, and polytetrafluoroethylene) and wear-resistant particles (i.e., SiC, TiC, $Cr_3C_2$) homogeneously suspended in a conductive metal (i.e., Ni, Fe, Cu, Mo, Ti) complementary and platable onto the solid-core wire strand.

The invention, in a second aspect, is a method of thermal spraying to produce a metal matrix composite coating, comprising providing a thermalizing through-flow chamber with an exit nozzle, the chamber having a desired gas flow-through; establishing a melting zone (i.e., flame, plasma, arc) in the chamber; and feeding a composite coated wire into the melting zone to be melted with projection of the melted metal and suspended constituents by the gas flow, to a target, the wire being comprised of a conductive metal solid core mandrel and a metal matrix composite coating on said mandrel, the composite coating consisting of constituent solid lubricant particles and/or wear-resistant particles embedded in a coating of the conductive metal complementary to the mandrel.

In still another aspect, the invention is a cast aluminum-based engine cylinder block having a plurality of cylinder bore walls coating with a mixture of solid lubricant and wear-resistant particles suspended in a matrix of a conductive metal complementary to the aluminum-based metal of the block.

BRIEF DESCRIPTION OF THE DRAWINGS

FIG. 9 illustrates a sequence of steps used in coating the internal cylinder bores of an engine using this invention.

DETAILED DESCRIPTION AND BEST MODE

Composite and its Fabrication

Figure 2:
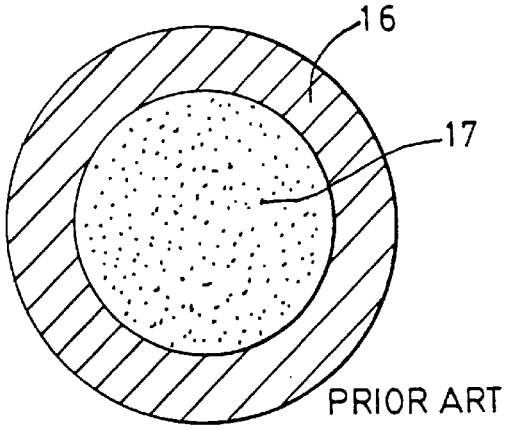
FIGS. 2 and 3 are enlarged cross-section views of prior art composite metallizing wires.

The new composite wire useful in thermal spraying techniques disclosed herein is comprised of an elongate strand 10 having a preformed or extruded wire core or mandrel 11 comprised of (i) a suitable conductive metal, (ii) a composite coating 14 consisting of a codeposited metal 15 (similar or complementary to that of the core) solid lubricant particles 12, and wear-resistant particles 13, and (iii) in some cases, an outer protective sheath 90 such as copper. Such sheath may be necessary to protect equipment that feeds the coated wire from possible abrasion due to the wear-resistant SiC phase. The Cu sheath would prevent oxidation of the composite coating and improve feeding of the coated wire through pinch rolls and gun orifices. The codeposited metal and lubricant and wear-resistant particles are deposited by an electrolytic or electroless process ensuring that the particles will be suspended or embedded within layers of the plating metal. The character of the coating 14 can be adjusted by controlling the amount of dispersant in the plating bath and also by varying the composition and relative dimensions of the mandrel wire and coating.

The core or mandrel metal is preferably selected from the group consisting of nickel and its alloys, chromium, titanium, iron, copper, tainless steel, plain carbon steel, and aluminum, because of the conductive nature of the metals and suitability for accommodating metallic coatings. Various alloys (both equilibrium and non-equilibrium could be devised to complement the mandrel or core metal of the wire.

The plating metal is preferably complementary to the core metal so that, for example, if the core metal is copper, the coating can be nickel with a Monel formulation, or, more directly, if the core metal is nickel, the plating metal will also be nickel. The lubricant particles are preferably selected from the group consisting of graphite, boron nitride, $MoS_2$ (molybdenum disulfide), and polytetrafluoroethylene (Teflon); the wear-resistant particles are preferably selected from the group consisting of silicon carbide, titanium carbide, and chromium carbide. Other "wear-resisting" particles could be employed.

Figure 3:
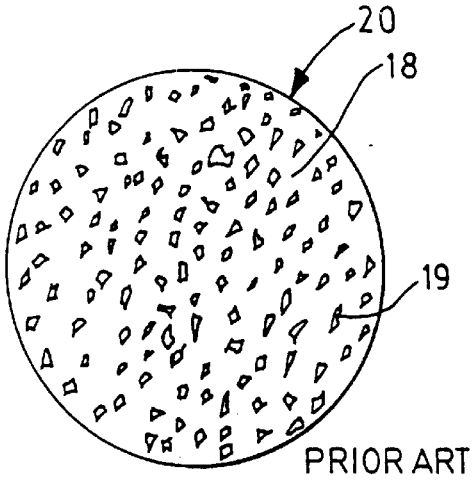
Figure 1:
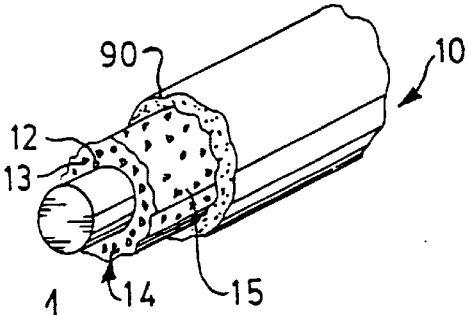
FIG. 1 is an perspective view of the composite wire of this invention showing a portion thereof in section.

Composite wires formed by the prior art has resulted in one of two construction formats as shown in FIGS. 2 and 3. In FIG. 2, a tubular wire, consisting of an iron-based sheath 16, is filled with a powdered additive 17 such as powdered graphite and iron powder. During a roll-forming process, the graphite is compacted solidly within such hollow space. Such a filled wire is subject to oxidation and degradation of the graphite during thermal spraying processes with the wire, unless special precautions are taken. The metallizing wire 20 of FIG. 3 has a solid matrix metal 18 with a dispersed phase 19, the matrix being typically aluminum with a dispersed phase of silicon carbide or aluminum oxide; this wire is formed by an extruding a metal matrix composite billet having the dispersed phase preformed therein. Such a wire is offered by Alcan Aluminum Company under the DURALCAN trade name. A limitation of this wire is that formation is limited to those metal matrix composites which can be formed in the melt and then worked into billet form. Nickel alloys have not been amenable to this process, for example.

Figure 4:
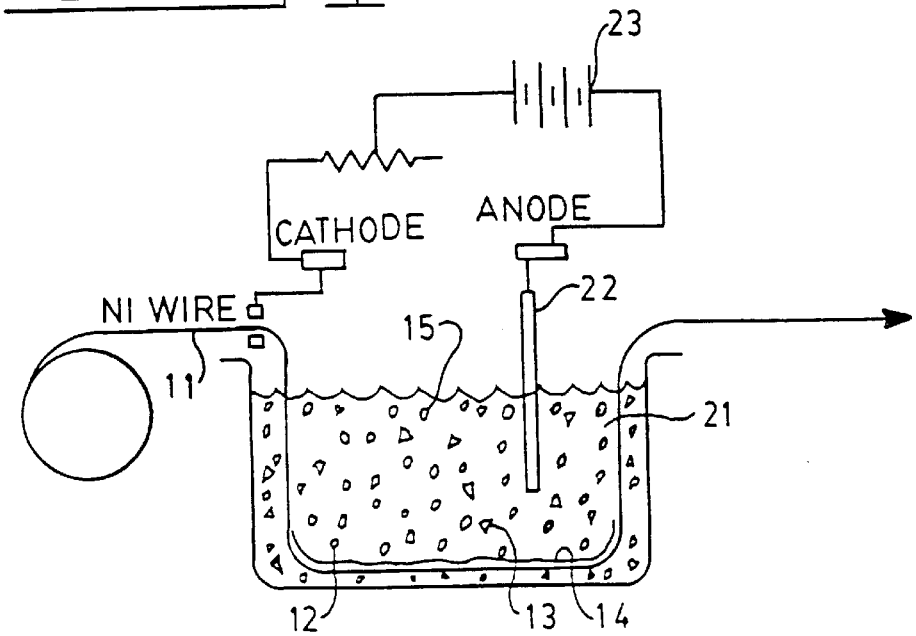
FIG. 4 is a schematic illustration of an electroplating system useful in fabricating the composite metallizing wire of this invention.

In contradistinction, the composite wire of this invention is made (as shown in FIG. 4) by (a) submersing a solid core preform mandrel 11 of conductive metal in an electrolyte 21 having the wire connected as a cathode and a conductive metal anode 22 disposed therein, the electrolyte containing a dispersion of wear-resistant particles 13 and/or solid lubricant particles 12, and (b) energizing the electrolyte to deposit metal ions 15 from said anode along with such suspended particles to form a composite coating 14 on the mandrel. A spool of the preformed solid mandrel 11 may be directed into the electrolyte containing a salt of the metal to be coated onto the mandrel wire. An external source of current 23 is connected to each of the electrodes.

The constituents of the electrolyte are preferably nickel sulphate, nickel chloride, and boric acid. The nickel sulphate concentration determines the limiting current density for obtaining the nickel deposit of the coating. Increasing the nickel concentration will permit the use of higher cathode current densities and faster plating rates. Preferably, the nickel sulphate is present in an amount of 30–50 ounces per gallon (or 225–375 grams per liter) and its nominal value is optimally about 44 ounces per gallon (or 330 grams per liter). The nickel chloride improves anode corrosion and increases conductivity. Increased conductivity is of practical importance because it reduces the tank voltage required to achieve a given current density. Nickel chloride is preferably present in an amount of 4–8 ounces per gallon (or 30–60 grams per liter), the nominal value being about six ounces per gallon. Boric acid helps to produce a whiter, smoother, more ductile deposit and is preferably present in an amount of 4–5.3 ounces per gallon (or 30–40 grams per liter) with a nominal amount at about five ounces per gallon. The electrolyte is preferably maintained at a temperature of 110–150° F. (45–65° C.), and at a pH of 1.5–4.5, and a current density of 25–100 amps/$ft^2$, with a nominal current density at about 50 amps/$ft^2$.

It is desirable to maintain a deposition rate of about 4–16 microns per minute to produce a coating thickness of about 30 microns or greater thickness to achieve suitable dispersion of particles (i.e., up to about 200 microns). The solid lubricant powder should be present in the electrolyte in a concentration in the range of 10–200 grams/liter, and the wear-resistant particles should be present in the electrolyte in a concentration in the range of from 20–150 grams/liter to produce suspended particles in the coating in the weight range of about 1–5%.

If an electroless plating technique is used to deposit the composite coating (sometimes referred to as chemical plating) the plating bath content will be based on catalytic reduction of metal salts. The chemical reducers commonly employed are sodium hypophosphite, formaldehyde, sodium borohydride, and amino borons. The electroless baths are formulated so that the metal salt and the reducer will react only in the presence of the catalyst. For example, in providing an electroless plating of nickel, the acid bath should contain nickel chloride, sodium glycollate, sodium hypophosphite, the bath being maintained at a pH of 4–6, and at a temperature of about 190° F., when an acid bath is used. If an alkaline bath is used, the bath will consist of nickel chloride, sodium citrate, ammonium chloride, sodium hypophosphite, with a pH of 8–10 and a temperature of about 190° F.

Use of Composite Wire

Figure 5:
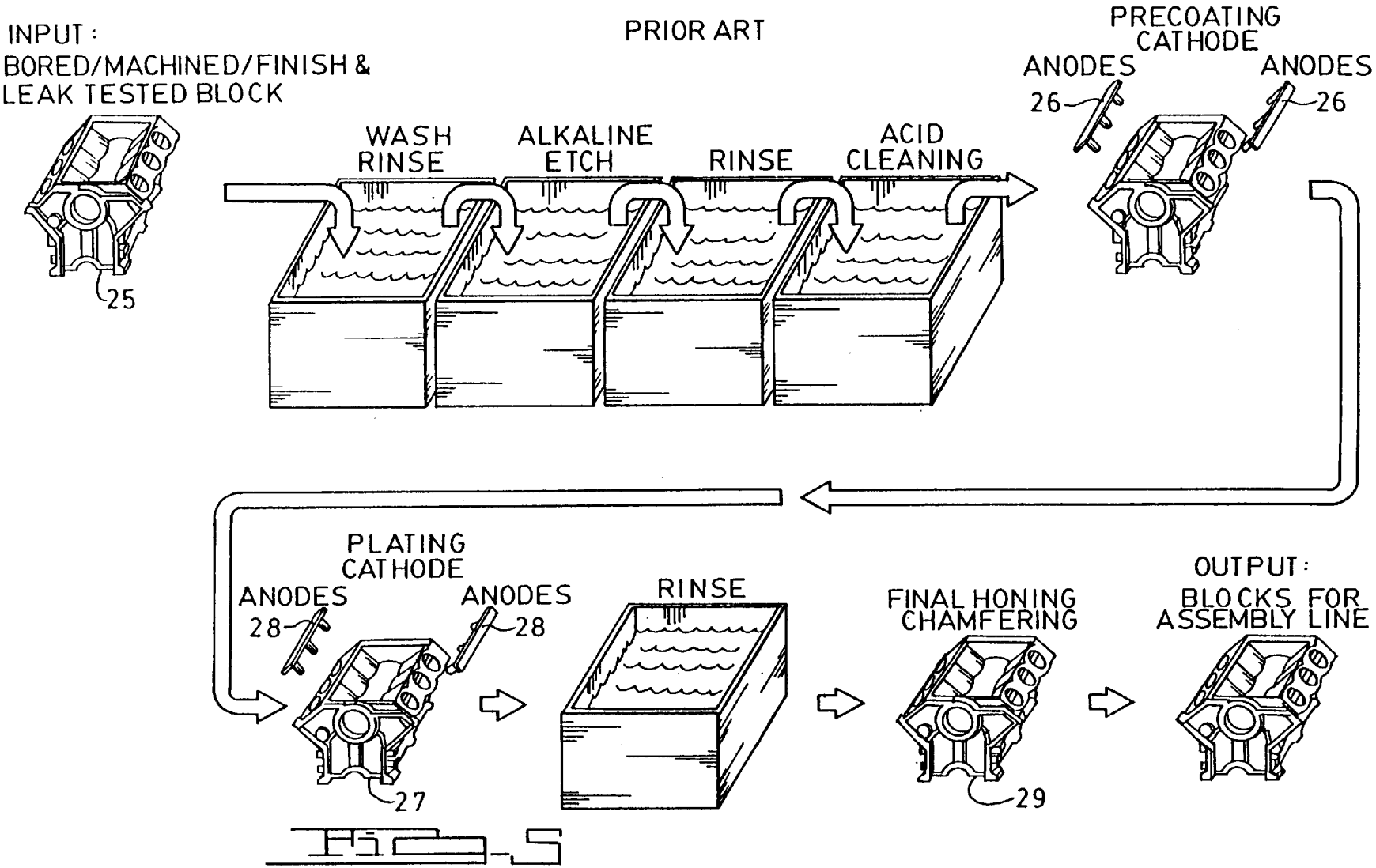
FIG. 5 illustrates a sequence of steps used by the prior art in plating internal bores of a conventional engine cylinder block.

Use of aluminum alloys for engine block construction has brought into focus new scuff and friction problems associated with oil lubricated pistons riding against cylinder walls. One prior art approach to such problems (as shown in FIG. 5) includes the use of a tedious wet plating approach for the cylinder bores. The semifinished aluminum block 25 (after bore machining and leak testing) is subjected to several sequential baths for preparation of the cylinder bore surfaces (washing, etching, rinsing, and acid cleaning). The block 25 is filled with banks of anodes 26 and a precoating cathode deposits a precoat on the cylinder bores. The surface prepared block 27 is then fitted with a plating cathode and banks of anodes 28 to receive a composite coating, such as nickel and silicon carbide in a thick coating. The coated block 29 is then rinsed and given final honing and chamfering. The problems with this approach are the overall slowness of deposition for mass production processing, and the necessity of dealing with various chemical etchants, rinses, baths, etc. in the engine plant or companion facility.

Figure 6:
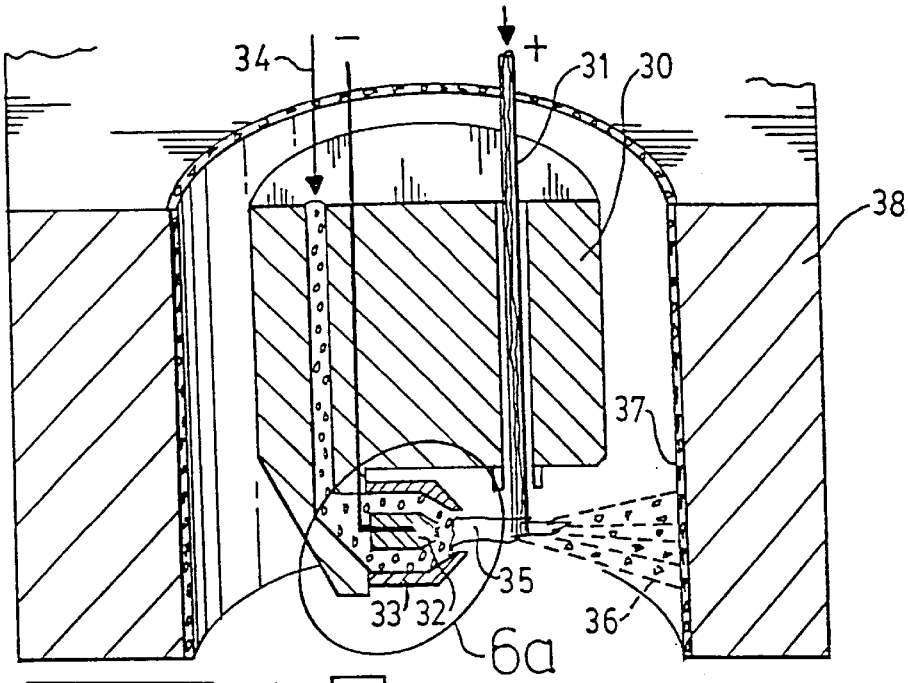
FIG. 6 is schematic sectional view of an engine cylinder bore using a prior thermal spraying system of applicant to coat a composite coating on the cylinder bore.
Figure 6A:
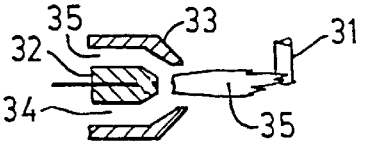
FIG. 6A is a slightly enlarged view of a circled portion of figure b.

As shown in FIG. 6, wet baths can be eliminated and each cylinder bore coated individually by an electric-arc thermal spray head 30 (such as disclosed in U.S. application Ser. No. 998,074 now U.S. Pat. No. 5,364,663, commonly assigned to the assignee herein). In this method, a hollow core, powder filled wire 31 is connected as the anode (+) and a cathode assembly 32 (–) is supported in a nozzle 33 through which compressed air or inert gas, or plasma initiating gases, is conveyed in channel 34. The arc 35, struck between the electrodes 31 and 32, melts and progressively consumes the end of the hollow core cathode wire, the compressed air or alternate plasma and shrouding gases spray the melt at 36 to the cylinder bore wall 37 of block 38 as a target. The deposition temperature is in the range of 300–500° F. and thus no cooling of the aluminum alloy cylinder bore wall is used or needed. Although this method is successful, greater rates of deposition and adhesion quality are desirable. If such hollow core wire were subjected to thermal spraying that experiences a different melting pattern or greater spray velocities (greater than that provided by electric arc thermal spraying), the wire will break off in chunks and produce a nonuniform coating with the core powder not being thoroughly distributed in the codeposited metal of the coating.

The method of this invention overcomes such problem by (a) providing a thermalizing through-flow chamber with an exit nozzle, the chamber having a gas flow therethrough, preferably of at least 100 $ms^{-1}$; and (b) establishing a heated melting zone, such as a flame, in the chamber; and (c) feeding a composite coated wire into such zone to be melted and projected by said gas flow to a target, said wire being comprised of a solid core mandrel and a metal matrix composite coating on said mandrel, the composite coating consisting of solid lubricant particles and/or wear-resistant particles embedded in a conductive metal layer complementary to the mandrel.

Figure 7A:
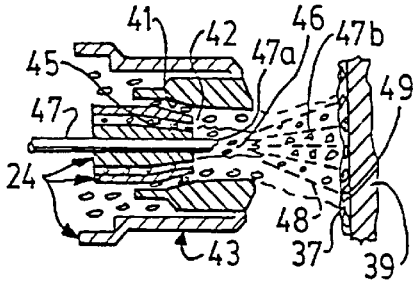
FIG. 7*a* is a slightly enlarged view of a circled portion of FIG. 7.
Figure 7:
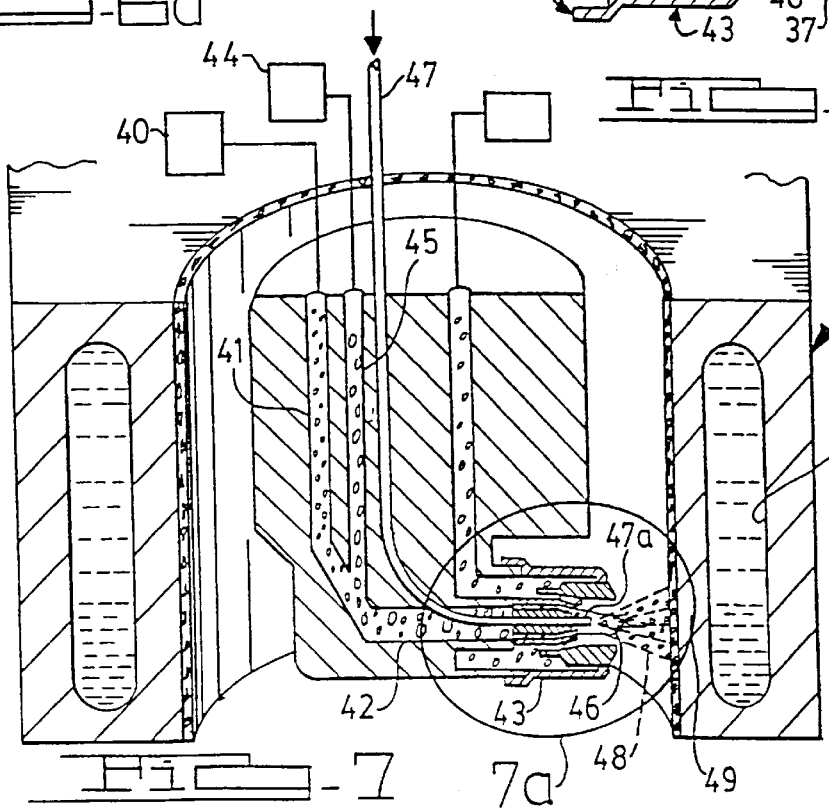
FIG. 7 is an enlarged perspective sectional view of a cylinder bore being coated by a thermal spray apparatus in accordance with this invention.

As shown in FIG. 7, a flame 46 may be established in the through-flow chamber 42 by combusting a mixture of oxygen (air) and fuel (propylene, propane or acetylene). The compressed air or oxygen (at a pressure in the range of 40–200 psi) is continuously delivered from a supply 40 along a passage 41 to a nozzle 24 cooperating to define the through-flow chamber of head 43. The nozzle has a shell 24*a*, an insert 24*b*, and an air cap 24*c* which provide passages for the gas flows. Fuel is continuously delivered from a supply 44 along a passage 45 into the nozzle 42 enveloped by the air in chamber 45. Such mixture, when ignited, produces the oxy-fuel flame 46. The composite coated wire 47, of the construction described above, is fed through the insert of the nozzle 24 to intersect the flame 46 and have its tip 47*a* progressively melted into molten droplets 47*b*. The force of the flame 46 sprays the molten droplets of the wire, containing hot solid particles, in a pattern 48 onto the cylinder bore wall 49 of block 39 to deposit the composite coating 37. The spray pattern can be concentrated or diffused depending on the angle of shrouding of the compressed air.

The flame temperature of combusted propylene is in the range of about 3000–3100° C., which would heat, by way of either radiation or conduction, the aluminum alloy of the cylinder bore walls significantly. To maintain the temperature of the wall 49 below a softening temperature, cooling water is circulated through the water jacket or passages 50 of the block to carry away excess heat during the thermal spraying process. The use of the composite coated solid core wire eliminates uneven melting of the wire and permits composite materials to be applied using a high-velocity oxy or air/fuel deposition technique. The thickness of the coating on the cylinder bore is controlled through feed rate of the wire into the torch, rotational speed, and axial speed of the applicator, and deposition efficiency of the process.

Figure 8:
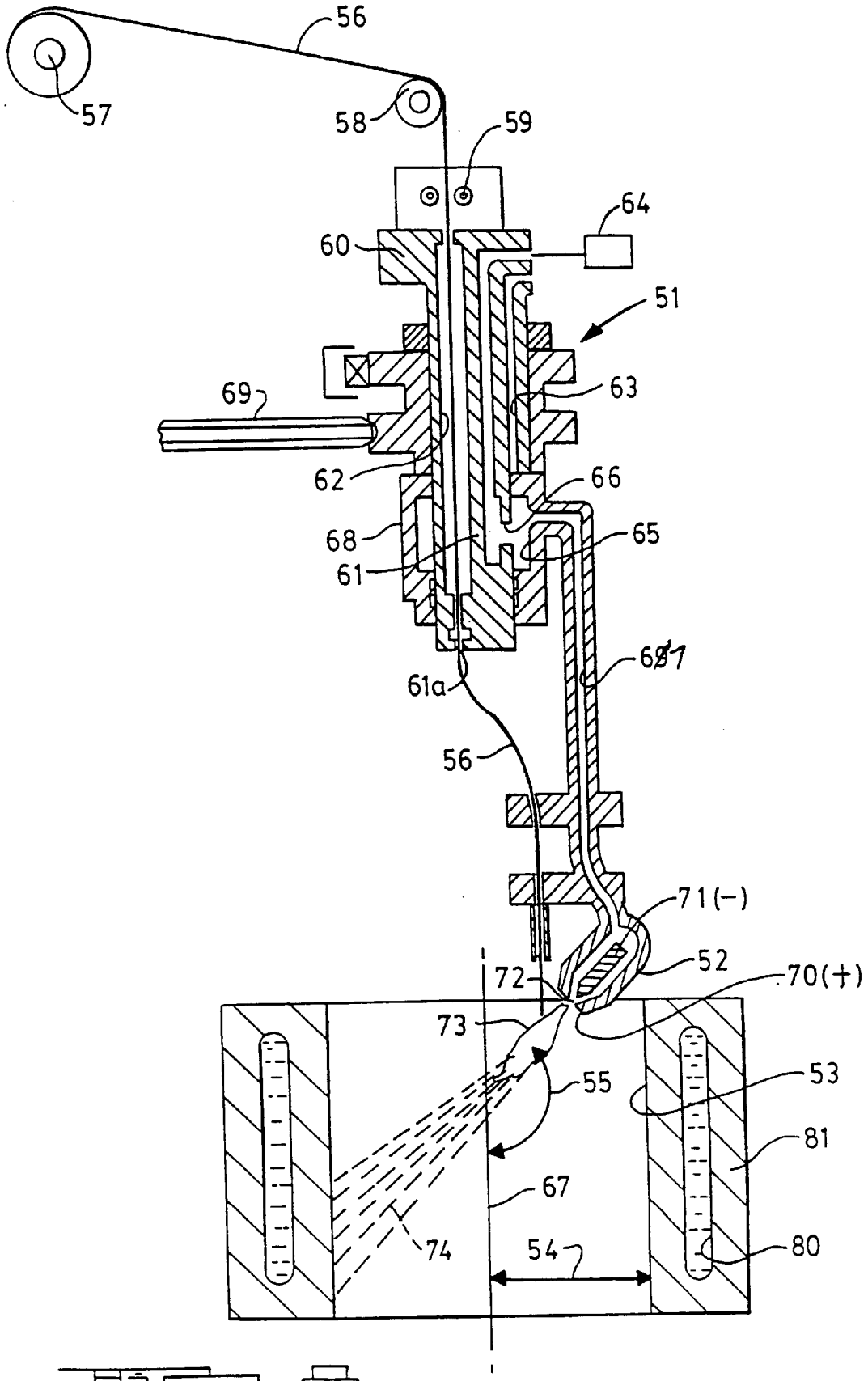
FIG. 8 is an elevational sectional view of still another apparatus used in carrying out coating a cylinder bore of a block in accordance with this invention.
Figure 5:
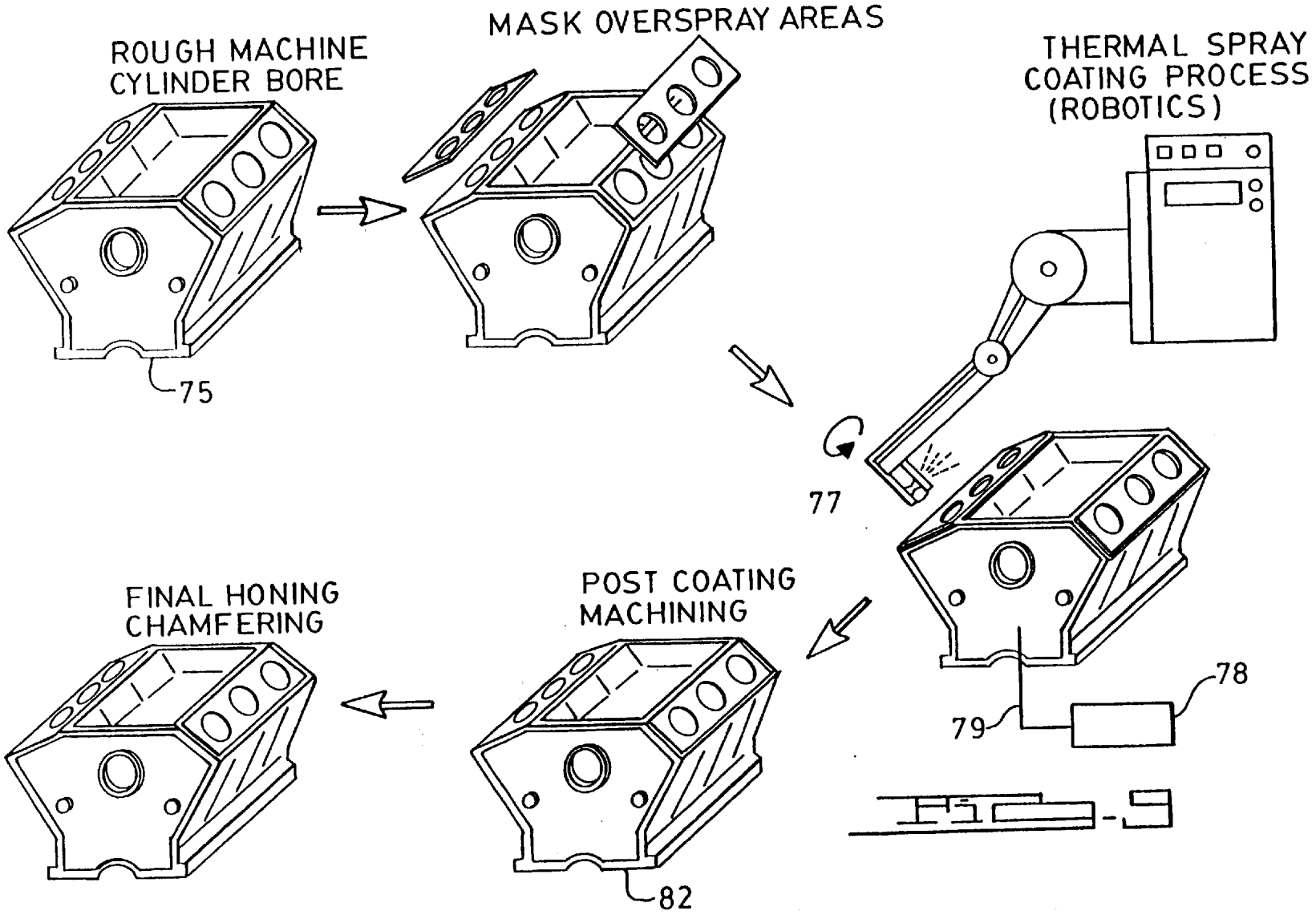

Alternatively, the flame may be a plasma as generated by the spray head 52, as shown in FIG. 8. A robotically controlled support apparatus 51 carries the thermal spray head 52 in a manner to rotate along the interior periphery of the bore 53, preferably about axis 67 of the bore, aiming the head to spray a distance greater than the radius 54 of the cylinder bore and at a downward direction, angled greater than 90° with respect to the axis 67 of the cylinder bore (the angle 55 being in the range of 90–120°). The composite coated wire 56 (of construction described above) is fed from a spool 57 about a pulley 58 as it is pulled by knurled pinch rollers 59 on a fixed support 60. The fixed support has a depending body 61 with aligned passages. One passage 62 allows the wire to pass through to the exit 61*a* at the bottom thereof, and the other passage 63 conveys an ionizable gas from a supply 64 to a port 66 in communication with a pocket or slip space 65. A rotatable structure 68, moved by a driven gear wheel 69, has walls defining the annular pocket 65 which communicates at all times with port 66 of the body 61; a passage 67 depending from structure 68 communicates the pocket 65 with the spray head 52.

The spray head 52 has a nozzle-shaped anode 70 (i.e., made of copper) and an internal-spaced nosed cathode 71 (i.e., tungsten). Current is supplied to the electrodes to strike an electrical arc therebetween and across gap 72, which electrical arc partially ionizes the gas supplied from passage 69 (i.e., argon or nitrogen gas molecules) to create a plasma plume 73. The composite coated solid core wire 56 is introduced to plume 73 and melted progressively thereby to be sprayed in a pattern 74 as the result of the inherent velocity of the plume. The flame temperature of the plume can be up to 10,000° K and the gas velocity of the plume can be up to 600 $ms^{-1}$. An arc may develop (or continue to exist after plume is formed) between the cathode (71) and the tip of the wire 56. This is effectively a "transferred arc" arrangement. Cooling may be desirable to maintain the cylinder wall temperature below its softening temperature, such as by a flow of cooling fluid through the water jacket passages 80 of the block 81. The coating resulting from such plasma spray technique is characterized by an adhesion of 35–70 $Nmm^{-2}$ and a porosity of 0.5–10%.

The thermal spray of FIGS. 7 and 8 can advantageously be used to coat the walls of a multicylinder engine block 75 as shown in FIG. 9. After rough machining of the cylinder bores, an overspray mask 76 is placed over the upper surfaces of each cylinder bank. A robotically controlled thermal spray head 77 (of the type shown in FIGS. 7 or 8) is inserted and simultaneously rotated to deposit a full and uniform composite coating on the interior bore walls while cooling water is circulated from a pump 78 through passages 79 into the block 75 adjacent the cylinder bores. After coating is completed to a uniform thickness in the range of 50–500 mm, the coated block 82 is machined exteriorly and then honed and chamfered interiorly.

I claim:

1. A selectively coated engine cylinder block comprising:

(a) a cast aluminum—based cylinder block having walls defining a plurality of cylinder bores;

(b) a wire-arc thermally sprayed coating on said walls, said coating consisting of silicon carbide particles and graphite particles suspended in a matrix of nickel-based metal, said coating having a ratio of graphite and silicon carbide particles to the matrix metal of 2:1 to 1:2, said walls having a uniform pattern of asperities, resulting from impact of said thermally sprayed coating, which asperities provide for an intimate lock of said coating to the walls, said suspended silicon carbide and graphite particles being sized in the range of about five microns.

* * * * *